US005975555A

United States Patent [19]

Lehner et al.

[11] Patent Number: 5,975,555

[45] Date of Patent: Nov. 2, 1999

[54] CARRYING APPARATUS FOR THE RETAINING PARTS OF A SKI BINDING

[75] Inventors: Edwin Lehner; Gerhard Sedlmair, both of Farchant; Werner Messerschmidt, Garmisch-Partenkirchen, all of Germany

[73] Assignee: Marker Deutschland GmbH, Eschenlohe, Germany

[21] Appl. No.: 08/505,053

[22] Filed: Jul. 21, 1995

[30] Foreign Application Priority Data

Jul. 22, 1994 [DE] Germany ..... 44 25 996
Jan. 27, 1995 [DE] Germany ..... 195 02 607

[51] Int. Cl.[6] ..... A63C 9/08

[52] U.S. Cl. ..... 280/618; 280/607; 280/633

[58] Field of Search ..... 280/607, 602, 280/617, 618, 633, 636

[56] References Cited

U.S. PATENT DOCUMENTS

| | | | |
|---|---|---|---|
| 5,020,821 | 6/1991 | Leroy | 280/603 |
| 5,104,139 | 4/1992 | Brishoux | 280/607 |
| 5,211,418 | 5/1993 | Scherübl | 280/618 |
| 5,251,923 | 10/1993 | Stepanek et al. | 280/602 |
| 5,269,555 | 12/1993 | Ruffinego | 280/602 |
| 5,332,252 | 7/1994 | Le Masson et al. | 280/602 |
| 5,342,078 | 8/1994 | Stepanek et al. | 280/602 |
| 5,348,335 | 9/1994 | Desarmaux et al. | 280/633 |
| 5,413,370 | 5/1995 | Janisch et al. | 280/618 |
| 5,480,175 | 1/1996 | Astier et al. | 280/607 |
| 5,746,439 | 5/1998 | Boehm et al. | 280/602 |

FOREIGN PATENT DOCUMENTS

| | | |
|---|---|---|
| 40 41 046 A1 | of 0000 | Germany . |
| 41 24 965 A1 | of 0000 | Germany . |
| 90 17 486 U | of 0000 | Germany . |

*Primary Examiner*—Lanna Mai
*Assistant Examiner*—Avraham H. Lerner
*Attorney, Agent, or Firm*—D. Peter Hochberg

[57] ABSTRACT

A carrying apparatus for supporting a ski binding toe piece and heel piece on a ski, the carrying apparatus having a length-adjustable coupling member arranged between a front support member and a rear support member. The carrying apparatus is easily mountable to the ski and is adaptable to accommodate numerous ski boot sizes.

19 Claims, 6 Drawing Sheets

CARRYING APPARATUS FOR THE RETAINING PARTS OF A SKI BINDING

FIELD OF THE INVENTION

The present invention relates to a carrying apparatus for a ski binding, and more particularly to a carrying apparatus having a length-adjustable coupling member that interacts with an adjustable stop member to influence the bending characteristics of a ski.

BACKGROUND OF THE INVENTION

U.S. Pat. No. 5,251,923 and corresponding German Utility Model No. 9,017,486 disclose a carrying apparatus for a ski binding that influences the bending characteristics of a ski. The front and rear retaining parts of the ski binding (i.e., the toe piece and the heel piece) are supported by the carrying apparatus. The carrying apparatus includes a front support member and a rear support member. An adjustable stop member is attached to the front support member. A longitudinally-extending slide member is attached at one end to the rear support member. The front end of the slide member is movable and is operatively engageable with the adjustable stop member. In this respect, the stop member is adjustable to select the size of the spacing between the stop member and the front end of the slide member. Accordingly, the size of the spacing can be selected such that the front end of the slide member is engageable with the stop member only when the front and rear ends of the ski are bent upwards to a great extent, relative to the center of the ski. Alternatively, the size of the spacing can be selected such that the front end of the slide member is engageable with the stop member when the front and rear ends of the ski are bent upward, only a small amount, relative to the center of the ski.

The front and rear retaining parts of the ski binding must be arranged at various distances from one another in order to accommodate different ski boot sizes. Since the front and rear retaining parts are respectively arranged above the front and rear support members of the carrying apparatus, the front and rear support members must also be arranged at various distances from one another. However, it is necessary to maintain the distance between the front end of the slide member, which is attached at one end to the rear support member, and the stop member, which is attached to the front support member. Accordingly, it is necessary to adjust the length of the slide member to maintain the distance between the front end of the slide member and the stop member. With prior art carrying apparatuses, it has not been possible to adjust the length of the slide member after the front and rear support members are mounted to the ski.

The procedure for mounting prior art carrying apparatuses to a ski is complicated. First, fastening holes for the front support member of the carrying apparatus are drilled on the ski by means of an installation and drilling tool. The front support member is then secured to the ski using fasteners. The front retaining part is then secured to the slide member, which in turn is attached by a screw to the rear support member. Thereafter, the front end of the slide member is slidably engaged with the front support member. The length of the slide member attached to the rear support member is then adjusted to accommodate the respective ski boot size. In this respect, the stop member is moved to an extreme position (i.e., the furthest rearward extending position) and the screw attaching the slide member to the rear support member is loosened to permit length of the slide member to be adjusted such that the front end of the slide member is brought to bear on the stop member. Fastening holes for the rear support member are then drilled on the ski, using the fastener-receiving holes on the rear support member (or on parts connected thereto and intended for receiving fastening screws) as a second hole gauge. Thereafter, the screw attaching the slide member to the rear support member is tightened. The rear retaining means is then secured to the rear support member.

The prior art carrying apparatus requires the use of two installation and drilling tools for mounting the carrying apparatus to a ski. Also, it was necessary to drill through the rear support member very carefully in order to make a precise position of the front and slide member relative to the stop member. Moreover, the length of the slide member must be adjusted before the rear support member is fastened to the ski. Furthermore, the screw attaching the slide member to the rear support member may loosen during skiing, thus impairing the binding performance. In this respect, the distance between the stop member and the front end of the slide member could inadvertently change.

The present invention overcomes these and other drawbacks of prior art devices.

SUMMARY OF THE INVENTION

The present invention is directed to a carrying apparatus for supporting the toe piece and the heel piece, or the front retaining part and the rear retaining part, of a ski binding and influencing the bending characteristic of the ski. The carrying apparatus for the retaining parts is comprised of a front and rear support means, a stop means fixable to said ski and a length-adjustable coupling means extending between the front and rear support means, the coupling means having a free end and a fixed end. The fixed end of the coupling means is attachable to the other of said support means, while the free end of the coupling means is operatively engageable with the stop means when the ski bends by a predetermined amount to influence the bending characteristic of the ski. The free end is locatable at a predetermined reference position to change the distance of movement between the free end and the stop means, by adjusting the length of the coupling means.

According to the present invention there is provided a carrying apparatus for the retaining parts of a ski binding, having a front and a rear support member, and a two-part longitudinally extending coupling member arranged therebetween. The coupling member is comprised of a continuation member and a slide member coupled to each other.

It is an object of the present invention to provide a carrying apparatus for the retaining parts of a ski binding, which influences the bending characteristic of the ski and that is easily mountable to a ski.

It is another object of the invention to provide a carrying apparatus for the retaining parts of a ski binding, which influences the bending characteristic of the ski, as the ski flexes and counterflexes.

It is another object of the present invention to provide a carrying apparatus of the type described above being mountable to a ski using only a single hole gauge, adapted to the respective boot size, to produce the necessary fastening holes in the ski.

It is still another object of the present invention to provide a carrying apparatus of the type described above wherein all of the carrying apparatus fastening holes in the ski may be produced before any of the parts of the carrying apparatus are mounted on the ski.

It is yet another object of the present invention to provide a carrying apparatus for the retaining parts of a ski binding, having a coupling member whose length is adjustable after the front and rear support members of the carrying apparatus have been mounted to the ski.

These and other objects and advantages will become apparent from the following description of a preferred embodiment of the invention taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof and wherein.

DETAILED DESCRIPTION OF THE PREFERRED EMBODIMENT

Figure 1B:
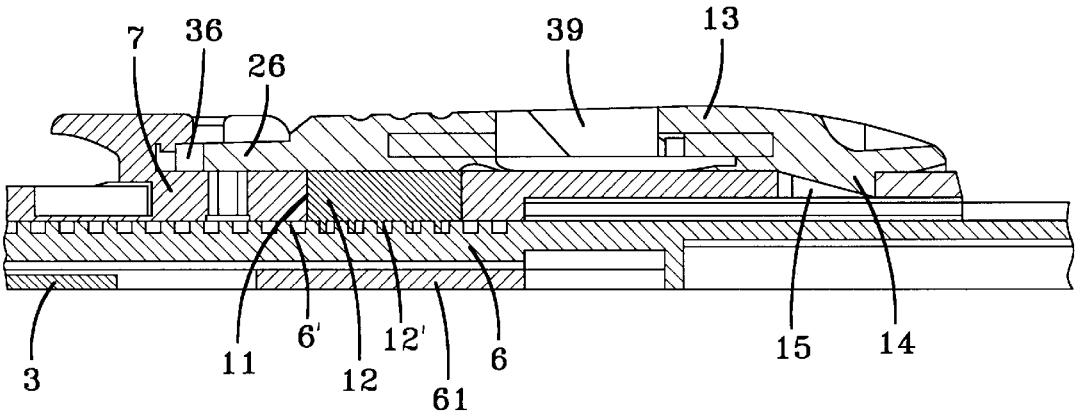
FIG. 1B is a longitudinal sectional side view of the carrying apparatus of FIG. 1A with an alternative slide member and cover.
Figure 5:
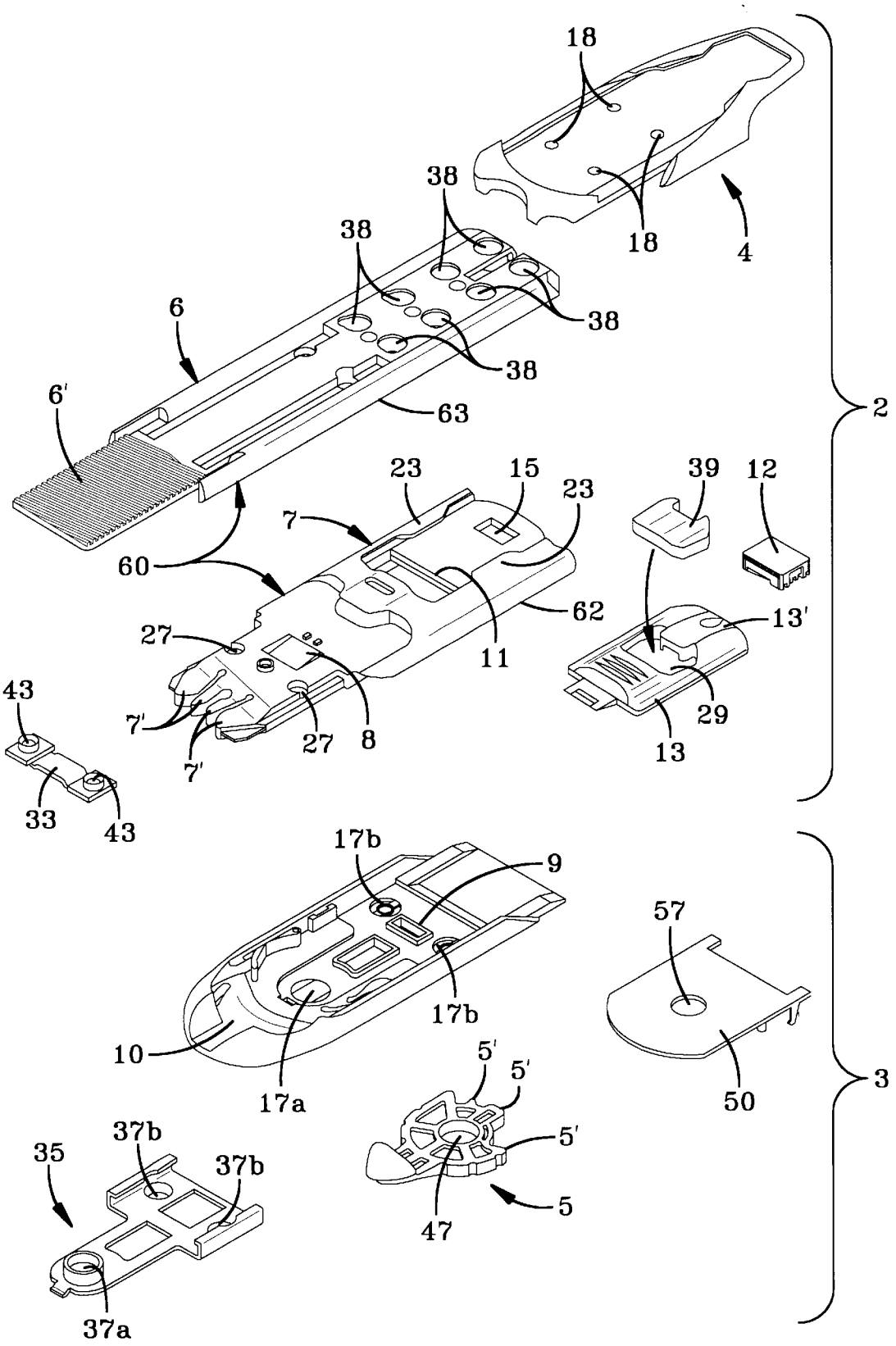
FIG. 5 is an exploded view of the carrying apparatus according to a preferred embodiment of the present invention with the alternative slide member and cover shown in FIG. 1B.
Figure 6:
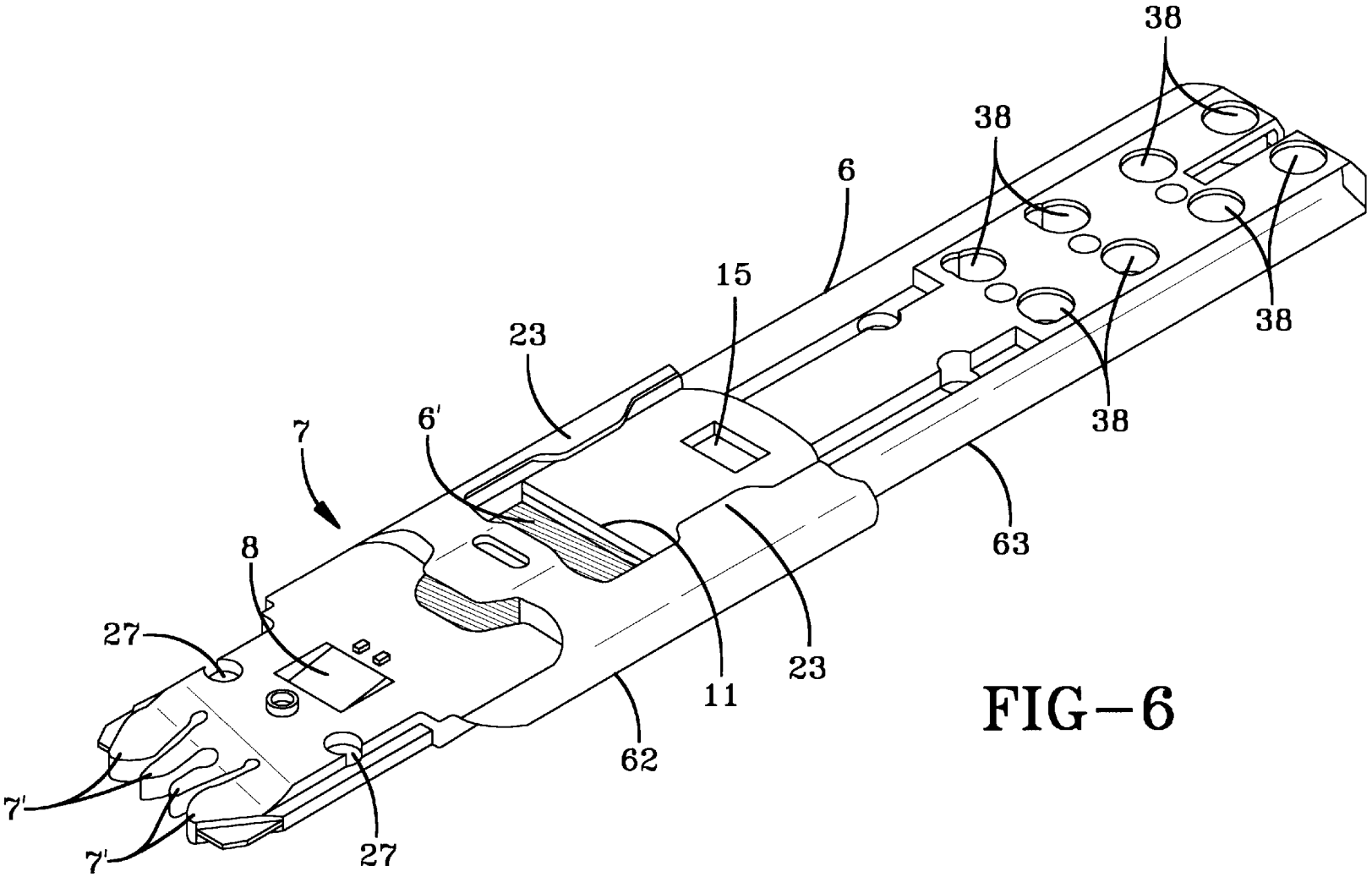
FIG. 6 is a perspective view of the coupling member of the present invention according to a preferred embodiment of the present invention, with the alternative slide member and cover shown in FIG. 1B.

Referring now to the drawings wherein the showing is for the purpose of illustrating a preferred embodiment of the invention only, and not for the purpose of limiting same, FIGS. 1A, 1B, 2 and 5 show a carrying apparatus 2 for the retaining parts of a ski binding according to a preferred embodiment of the present invention. It should be noted that FIG. 1B illustrates an alternative slide member and cover. FIGS. 5 and 6 incorporate the alternative slide member and cover as shown in FIG. 1B. Carrying apparatus 2 is generally comprised of a front support member 3, a length-adjustable two-part coupling member 60 (comprised of a continuation member or length adjustment member 6 and slide member 7), and a rear support member 4. Carrying apparatus 2 is arranged at the central region of ski 1. Front support member 3 and rear support member 4 are fixed to ski 1.

Coupling member 60 has a fixed end attachable to rear support member 4 and a free end operatively engageable with a stop member 5. A ski binding front retaining part or toe piece (not shown) is mounted above front support member 3, while a ski binding rear retaining part or heel piece (not shown) is mounted above rear support member 4.

As best shown in FIG. 5, front support member 3 is comprised of a housing 10, a housing bracket 35, a rotationally adjustable stop member 5 and a cover plate 50. Housing bracket 35 is attachable to housing 10. In this respect, housing bracket 35 is arranged on housing 10 such that holes 37*a* and 37*b* are aligned with holes 17*a* and 17*b* of housing 10. Stop member 5 is also attachable to housing 10. In this respect, bole 47 of stop member 5 is aligned with hole 37*a* of housing bracket 35. Furthermore, plastic cover 50 covers stop member 5. In this respect, hole 57 of cover 50 is aligned with holes 47, 37*a* and 17*a*. Fasteners (not shown) are inserted through aligned holes 17*a*, 37*a*, 47 and 57, and through aligned holes 17*b* and 37*b*. These fasteners are received by respective fastening holes formed in ski 1 (such as by drilling). Accordingly, front support member 3 is secured to ski 1. Housing 10 also includes hook-receiving member 9, which preferably takes the form of a transverse edge. Hook-receiving member 9 will be described in detail below.

Stop member 5 is preferably configured in a manner similar to a cam plate. A plurality of stop surfaces 5' (see FIG. 2) are arranged along the peripheral border of stop member 5. Different stop surfaces 5' may be selected to face the free end of coupling member 60 by rotational adjustment of stop member 5. Each stop surface 5' extends rearward (i.e., towards the rear support member) by a different amount.

As noted above, coupling member 60 is comprised of a length adjustment member 6 and a slide member 7. Length adjustment member 6 and slide member 7 are fixable to each other as will be described in detail below.

Length adjustment member 6 takes the form of a longitudinally extending flat extension. It should be understood that the term "longitudinally" as used hereinafter refers to the longitudinal direction of the ski. Furthermore, the term "transverse" as used hereinafter refers to directions transverse to the longitudinal direction of the ski. At the front end of length adjustment member 6 a toothing arrangement 6' is formed along the upper surface. Toothing arrangement 6' extends across the entire width of length adjustment member 6. It should be appreciated that toothing arrangement 6' is oblique or slanted relative to the longitudinal direction of the ski. Toothing arrangement 6' is used to fix the front end of length adjustment member 6 to the rear end of slide member 7, as will be explained in detail below. Guide holes 38, formed at the rear end of length adjustment member 6, are used to fix the rear end of length adjustment member 6 to rear support member 4, as will be explained below.

Slide member 7 extends in a longitudinal direction of the ski. Resilient fingers 7' are formed at the front end of slide member 7, and are operatively engageable with stop member 5 of front support member 3. The front end of slide member 7 also includes a pair of fastener-receiving holes 27 for attaching a ski binding front retaining part thereto. A recess (not shown) is formed on the bottom surface of slide member 7 in the region of holes 27 for receiving a toe bracket 33. Holes 43 in toe bracket 33 are aligned with holes 27 of slide member 7.

A locating member (described below) is formed on the lower side of slide member 7 for receiving the front end of length adjustment member 6. The locating member locates length adjustment member 6 coaxially with slide member 7. It will be appreciated that the front end of slide member 7 will extend longitudinally beyond the front end of length adjustment member 6 towards the front end of ski 1, as shown in FIG. 6.

A transverse-extending opening or window 11 is formed on the top side of slide member 7. Window 11 is dimensioned to receive an insert piece 12 which is used to fix length adjustment member 6 to slide member 7, as will be described in detail below.

A hook 8 is integrally formed in the center region of slide member 7 (see FIGS. 1A and 1B, 2–3 and 6). Hook 8 has some degree of tensile elasticity as a result of its shape which is arcuate in side elevation and/or as a result of a corresponding choice of elastic materials. Hook 8 is operatively engageable with corresponding hook receiving member 9 formed in housing 10 of front support member 3.

Figure 7:
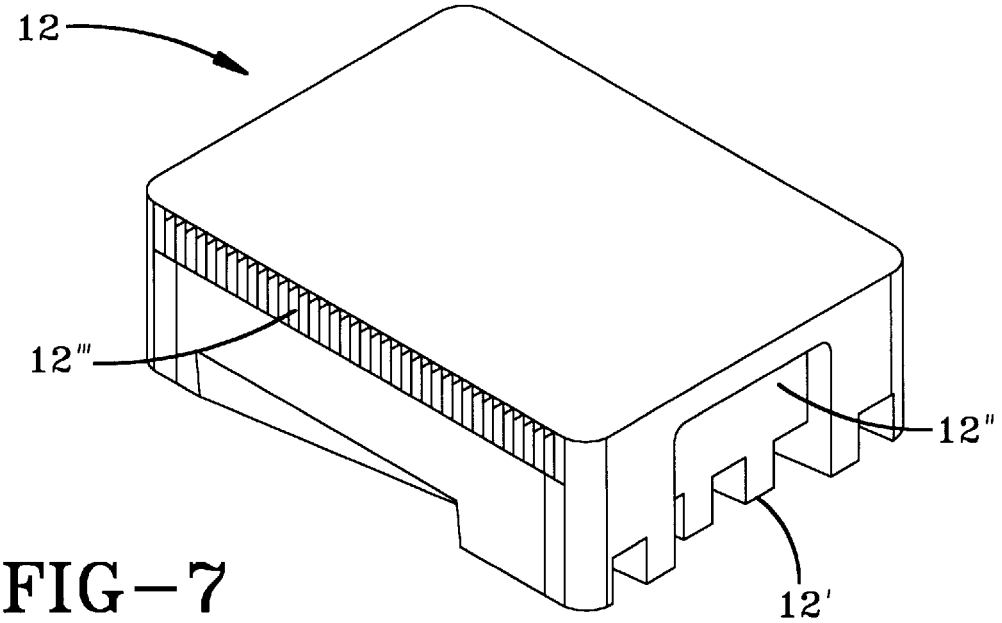
FIG. 7 is a top plan view of an insert piece according to a preferred embodiment of the present invention.
Figure 8:
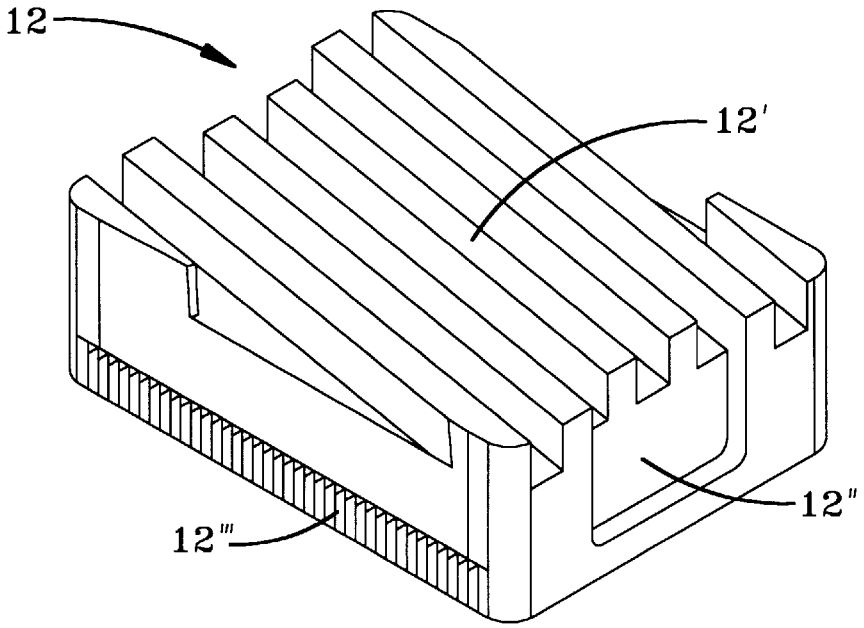
FIG. 8 is a bottom plan view of the insert piece of FIG. 7.

Referring now to FIGS. 7 and 8, there is shown perspective views of insert piece 12. Insert piece 12 is generally shaped as a rectangular block. The upper surface of insert piece 12 is smooth, as shown in FIG. 7. A mating toothing arrangement 12' is formed on the lower surface of insert piece 12, as shown in FIG. 8. Mating toothing arrangement 12' is oblique and dimensioned to engage with toothing arrangement 6' of length adjustment member 6. Recesses 12" are formed at opposite ends of insert piece 12 to aid in disengaging insert piece 12 from toothing arrangement 6' of length adjustment member 6, as will be described below. Furthermore, insert piece 12 includes ridges or small tooth 12'", which are formed along opposite sides of insert piece 12. Ridges 12'", provide high friction surfaces which are operatively engageable with respective edges of window 11, to firmly secure insert piece 12 in position within window 11, as will be described in further detail below.

Rear support member 4 includes one or more pairs of guide members 28 (see FIG. 1A) which correspond with guide holes 38 of length adjustment member 6. In this respect, guide members 28 are placed through guide holes 38 which correspond with the appropriate size boot. In this regard, different sets of guide holes 38 may be selected for engagement with guide members 28, to accommodate different boot sizes. Holes 18 are formed in two pairs of the guide members 28, and are dimensioned to receive fasteners for mounting the ski binding rear retaining part and rear support member 4 to ski 1.

The engagement of the front end of length adjustment member 6 and the rear end of slide member 7 will now be described with reference to FIG. 6. The front end of length adjustment member 6 is slidably engaged with slide member 7 with the assistance of locating members of slide member 7. The locating members include a bridge 61 extending across the underside of slide member 7 between the side walls of slide member 7, between which length adjustment member 6 can move (until locked in place), and also includes the inside of the side walls 62 of slide member 7, which extend below the underside of slide member 7 for engaging the side edges 63 of length adjustment member 6. When length adjustment member 6 is arranged at an appropriate position relative to slide member 7, a portion of toothing arrangement 6' will be accessible through transverse extending window 11 formed in slide member 7. As indicated above, insert piece 12 has longitudinal dimensions which correspond to the longitudinal dimensions of window 11. Furthermore, the transverse dimensions of insert piece 12 are considerably shorter than the corresponding dimension of window 11. Accordingly, insert piece 12 can be inserted into window 11 in various positions in a transverse direction of the ski. Mating toothing arrangement 12' of insert piece 12 interacts in a self-locking manner with toothing arrangement 6'. Thus, mating toothing arrangement 12' engages with toothing arrangement 6' without play. Moreover, the borders of insert piece 12, which run in a transverse direction, engage with adjacent transverse edges of window 11 to lock insert piece 12 in position within window 11. The high friction surfaces formed by ridges 121'" help to hold insert piece 12 securely in position within window 11.

Still referring to FIG. 6, lateral grooves 23 are formed along the upper surface of slide member 7. Lateral grooves 23 are dimensioned to engage with the longitudinal borders of a slide-like cover 13, shown in FIG. 5. Cover 13 prevents insert piece 12 from vertically disengaging from window 11. A latching slot 15 formed on slide member 7 engages with an engagement member 14 of cover 13 when cover 13 is in a closed position (as shown in both FIG. 1A and FIG. 1B). It will be appreciated that a further latching slot 16 may be formed on slide member 7 to engage engagement member 14 when cover 13 is in an open position (shown only in FIG. 1A). In its closed position, cover 13 covers window 11 and thus prevents insert piece 12 from moving in an upwards direction, i.e., moving along a vertical axis. It will be noted that the cover 13 shown in FIG. 1B includes a latching tongue 26, which is engageable with a second latching slot 36 to further lock cover 13 in a position. To open cover 13, rear border 13' of cover 13 is bent upwards and slid rearward. It will be appreciated that rear border 13' also serves as a handle for cover 13. As indicated above, cover 13 may engage with latching slot 16 when it is in its open position. However, it should be appreciated that it is advantageous to remove cover 13 entirely from slide member 7 upon opening cover 13. In this regard, cover 13 has additional utility as a tool for lifting insert piece 12 out from window 11 by means of engagement of the upper edge surface defining recess 12", or to move insert piece 12 in a transverse direction before mating toothing arrangement 12' of insert piece 12 has been engaged with oblique toothing arrangement 6' of length adjustment member 6. Furthermore, it will be appreciated that the foregoing utility of cover 13 is enhanced by recesses 12" formed on insert piece 12, which are dimensioned to receive a corner of cover 13.

It should be noted that cover 13 may be configured with an opening 29 dimensioned to receive an insert plate 39 (see FIG. 5). Insert plate 39 could be used, for example, to display a model number, a logo, or a trademark. Alternatively, cover 13 may be configured as a single piece.

Figure 1A:
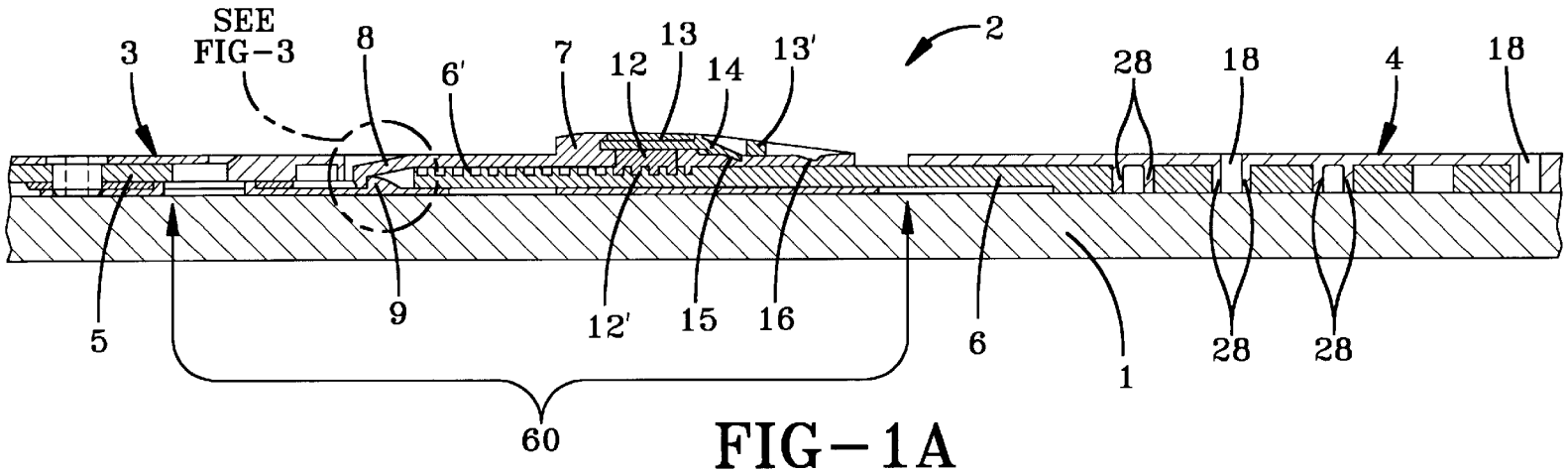
FIG. 1A is a longitudinal sectional side view of the carrying apparatus according to a preferred embodiment of the present invention.
Figure 2:
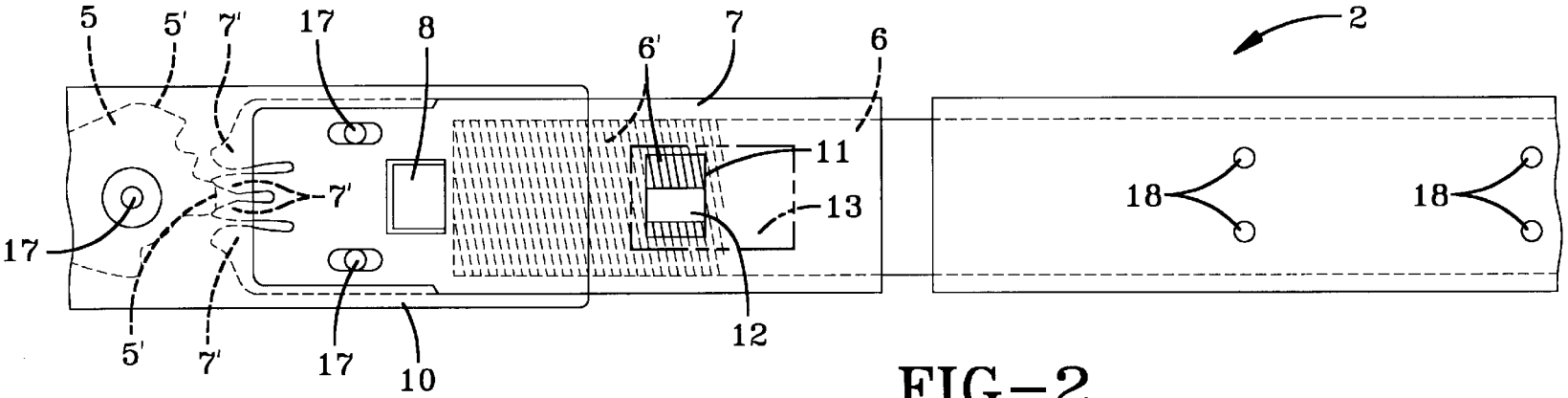
FIG. 2 is a top plan view of the carrying apparatus as shown in FIG. 1A.
Figure 3:
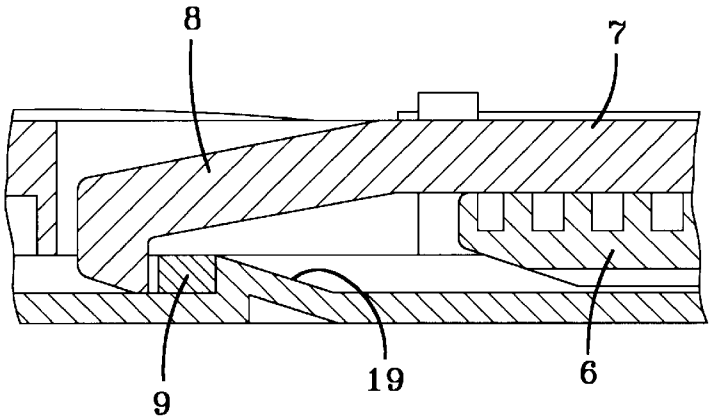
FIG. 3 is an enlarged longitudinal sectional side view of section III shown in FIG. 1A.

The positioning of slide member 7 relative to stop member 5 will now be explained with reference to FIGS. 2–4. Before slide member 7 is fixed to length adjustment member 6, it is positioned at a reference position, which may be established by a marking and/or a stop. In this respect, the distance between resilient fingers 7' of slide member 7 and stop surfaces 5' of stop member 5 is precisely selected. Slide member 7 is positioned by slidably engaging front end of slide member 7 with housing bracket 35 shown in FIG. 5. Housing bracket 35 allows slide member 7 to slide in the longitudinal direction of ski 1, but not in the direction of the vertical axis of ski 1 or in a transverse direction. The foregoing arrangement allows slide member 7 to be precisely positioned relative to stop member 5. As indicated above, the rear end of slide member 7 is fixed to the front end of length adjustment member 6 using insert piece 12.

The procedure for mounting carrying apparatus 2 to ski 1 will now be described in detail. First, all of the fastening holes necessary for mounting carrying apparatus 2 to ski 1 are drilled into ski 1 using an installation and drilling tool which is adapted to the respective boot size of the skier. In this respect, the longitudinal spacing of the ski-side fastening holes for mounting carrying apparatus 2 are dimensioned in accordance with the appropriate boot size. Next, front support member 3 is attached to the ski. In this respect, holes 17*a* and 17*b* of housing 10 are aligned with the holes drilled on the ski. Housing 10 would usually have housing bracket 35, stop member 5 and cover plate 50 preassembled and would be included when housing 10 is assembled with the ski. Fasteners are arranged through the holes to mount the front support member 3 to ski 1.

Next, slide member 7 is slidably engaged with front support member 3. In particular, slide member 7 is slidably engaged with housing bracket 35. As indicated above, the distance between slide member 7 and stop member 5 is crucial for proper operation of carrying apparatus 2, with regard to influencing the bending characteristics of ski 1. Accordingly, a marking on housing 10 may be used to correctly position slide member 7 relative to stop member 5. Alternatively, a locking or latching member may be engageable with slide member 7 to obtain the correct positioning of slide member 7. In a preferred embodiment of the present invention, the proper positioning of slide member 7 is obtained by sliding slide member 7 forward until hook 8 engages hook receiving member 9. Once hook 8 and hook receiving member 9 are engaged, the longitudinal movement of slide member 7 is limited. In this respect, forward movement is limited by stop member 5, while rearward movement is limited by hook receiving member 9.

It will be appreciated that before slide member 7 is engaged with front support member 3, a ski binding front retaining part is attached to slide member 7 using toe bracket 33 and inserting fasteners through aligned holes 27 and 43. Thereafter, length adjustment member 6 is slidably engaged with slide member 7, as in the manner described above. The appropriate holes 38 of length adjustment member 6 are aligned with the fastener-receiving holes drilled in ski 1 for receiving the carrying apparatus fastening screws. At this point in assembly, slide member 7 can move freely in a longitudinal direction, relative to length adjustment member 6 apart from a certain degree of self-locking between slide member 7 and length adjustment member 6.

Next, rear support member 4 is fixed to length adjustment member 6 by aligning guide members 28 with the appropriate guide holes 38 and inserting guide members 28 therethrough. The rear retaining part is then mounted to carrying apparatus 2 by arranging fasteners through holes 18.

Next, length adjustment member 6 is fixed to slide member 7. In this respect, insert piece 12 is inserted into window 11 and displaced in the transverse direction of ski 1 until mating toothing arrangement 12' of insert piece 12 is engageable with toothing arrangement 6' of length adjustment member 6. When this position is reached, insert piece 12 is pressed downward towards toothing arrangement 6' such that mating toothing arrangement 12' engages toothing arrangement 6'. It should be appreciated that the transverse position of insert piece 12 at which mating toothing arrangement 12' is engageable with toothing arrangement 6' will vary depending upon the position of slide member 7 relative to length adjustment member 6, since toothing arrangement 6' runs in a direction oblique with respect to the transverse displacement direction of insert piece 12 in window 11.

Once insert piece 12 has been pressed downward into oblique toothing arrangement 6' of length adjustment member 6, slide member 7 will be fixed in position relative to length adjustment member 6.

Insert plate 39 is ordinarily preassembled in cover 13. Cover 13 is slid into position on slide member 7 to cover window 11, as discussed above. In its closed position, cover 13 secures insert piece 12 in its position by preventing insert piece 12 from moving vertically out from window 11. With this last step, carrying apparatus 2 is now properly mounted to ski 1.

When carrying apparatus 2 is mounted to ski 1 in the manner described above, slide member 7 will be in precise position for interaction with stop member 5 and/or hook receiving member 9 to influence the bending characteristic of ski 1. As described above, resilient fingers 7' are operatively engageable stop surfaces 5' of stop member 5, as the ends of ski 1 are bent upwards relative to the central region of ski 1. As the ends of ski 1 are bent upwards, the distance between the ends of carrying apparatus 2 shortens in the longitudinal direction of ski 1. Accordingly, when the ends of ski 1 are bent upwards a relatively small amount, resilient fingers 7' will merely butt against stop surfaces 5 '. In contrast, when the ends of ski 1 are bent further (i.e., bent a relatively large amount), resilient fingers 7' will elastically deform to a more or less pronounced extent. The rigidity of ski 1, with respect to bending, will be strengthened to a different degree depending upon the adjustment (i.e., spacing) of stop member 5 relative to the end front end of slide member 7. Therefore, coupling member 60 (i.e., length adjustment member 6 and slide member 7) can transmit compressive forces between the front and rear support members, as the same draw near to one another, when the ends of ski 1 bends upwards relative to the center of ski 1.

When the ends of ski 1 are bent downward, the ends of carrying apparatus 2 will try to move further away from one another. Accordingly, hook receiving member 9 will try to draw hook 8 forwards in the longitudinal direction of ski 1 relative to the rear of carrying apparatus 2. This results in a stretching by means of friction of the hook, and this friction dampens vibration of the ski during the counterflex of the ski. Engagement of hook 8 with hook receiving member 9 will increase the rigidity of ski 1, when the ends of ski 1 are bent downwards relative to the central region of ski 1 (e.g., when skiing through a dip in the ground). Therefore, tensile forces can be transmitted between the front and rear support members by means of coupling member 60 (i.e., length adjustment member 6 and slide member 7), when the ends of ski 1 bend downwards relative to the center of ski 1, and the front and rear support members move away from one another.

It will be appreciated in order for carrying apparatus 2 to consistently affect the bending rigidity of ski 1, the interaction between stop surfaces 5' and resilient fingers 7', and the interaction between book 8 and hook receiving member 9 must be consistently reproducible.

As indicated above, coupling member 60 is preferably configured in such a manner that it is capable of transmitting both compressive forces and tensile forces between support members 3 and 4. Hook 8 and hook receiving member 9 may also function as stops for adjusting the reference position of slide member 7 relative to stop member 5. In this respect, after mounting support members 3 and 4 to ski 1, slide member 7 can be positioned relative to stop member 5, until hook 8 and hook receiving member 9 butt against one another. For instance, slide member 7 may be slid rearward until hook 8 and hook receiving member 9 butt against one another. Thereafter, slide member 7 and length adjustment member 6 are fixed, locked or latched to each other.

The present invention also provides for simple disassembly of carrying apparatus 2. Referring now to FIG. 3, it should be noted that slide member 7 cannot, without further action, be drawn out of housing 10 which guides it in the longitudinal direction of the ski. In this respect, hook 8 engages hook receiving member 9, which in a preferred embodiment take the form of a transverse edge. Moreover, hook 8 is not accessible from outside housing 10. In this regard, when a ski binding retaining part is mounted above front support member 3, it is particularly difficult to access hook 8, since the ski binding front retaining part typically covers hook 8. Accordingly, in a preferred embodiment of the present invention, length adjustment member 6 is used to release hook 8 from hook receiving member 9. In this respect, rear support member 4 is first detached from the ski. Thereafter, length adjustment member 6 is detached from slide member 7 by sliding cover 13 into an open position on slide member 7, and removing insert piece 12 from window 11. Length adjustment member 6 is then slid in a forward direction relative to slide member 7. During this procedure, the oblique underside surface of length adjustment member 6 slides onto a ramp 19 arranged to the right of hook receiving member 9. Thus, length adjustment member 6 necessarily presses from below against hook 8 which is configured or secured in the manner of a resilient tongue, so that the same is raised and necessarily lifted out of its locking engagement with hook receiving member 9. Thereafter, slide member 7 can be removed from housing 10 by sliding it rearward.

Figure 4:
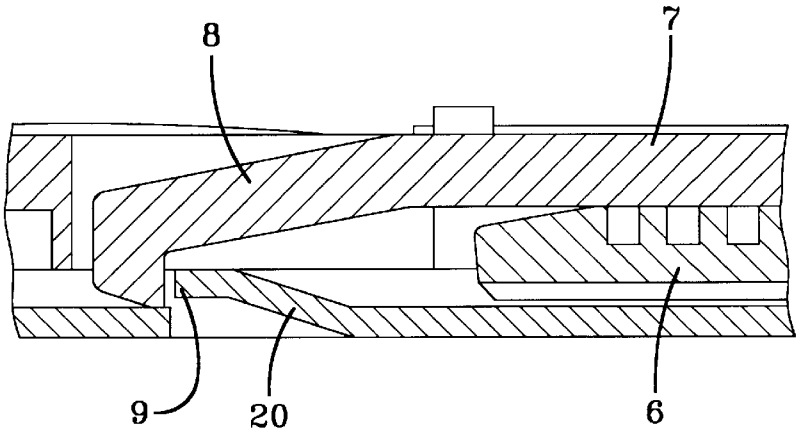
FIG. 4 is an alternative embodiment of section III shown in FIG. 3.

Referring now to FIG. 4, an alternative embodiment of hook receiving member 9 is shown. Hook receiving member 9 is arranged resiliently, such as on a resilient tongue 20. When length adjustment member 6 is displaced in a forward direction, relative to slide member 7, resilient tongue 20 is pushed away downwards out of the region of hook 8. Thereafter, slide member 7 can be drawn out of housing 10 by sliding it rearward.

It should be appreciated that the present invention allows slide member 7 to be precisely positioned relative to stop member 5 after front and rear support members 3 and 4 have been mounted to ski 1. Consequently, the ski-side fastening holes can be produced, and support members 3 and 4 can be mounted to ski 1 before the position of slide member 7 is adjusted and fixed relative to length adjustment member 6. Accordingly, the length of coupling member 60 comprised of length adjustment member 6 and slide member 7 can be adjusted after support members 3 and 4 have been mounted to ski 1. Furthermore, the present invention makes it possible to use only a single installation and drilling, adapted for a respective boot size, to aid in producing the required ski-side fastening holes.

The foregoing arrangement virtually eliminates mounting errors, since the correct spacing of front and rear support members 3 and 4 is ensured when using the correct installation and drilling tool, i.e., installation and drilling tool corresponding to the appropriate ski boot size.

The foregoing description is a specific embodiment of the present invention. It should be appreciated that this embodiment is described for purposes of illustration only and that numerous alterations and modifications may be practiced by those skilled in the art without departing from the spirit and scope of the invention. It is intended that all such modifications and alterations be included insofar as they come within the scope of the invention as claimed or the equivalents thereof.

We claim:

1. A carrying apparatus for supporting the retaining parts of a ski binding and influencing the bending characteristic of a ski, comprising:

front support means for supporting a ski binding front retaining means;

rear support means for supporting a ski binding rear retaining means;

stop means fixable at a position relative to said ski;

length-adjustable coupling means extending between said front and rear support means and having a fixed end attachable to one of said support means longitudinally spaced from the position of the stop means, and a free end movable relative to, and operatively engageable with, the stop means when the ski bends by a predetermined amount, to influence the bending characteristic of the ski, the free end of the coupling means locatable at a predetermined reference location to change the distance of movement between the free end and the stop means, by adjusting the length of the coupling means.

2. A carrying apparatus according to claim 1, wherein said free end of said coupling means is located at said predetermined reference position.

3. A carrying apparatus according to claim 1, wherein said coupling means comprises:

a continuation member having said fixed end of said coupling means; and slide means having said free end of said coupling means and being slidably engageable with said continuation member.

4. A carrying apparatus according to claim 3, wherein said coupling means further comprises means for fixing said continuation means to said slide means to establish the length of said coupling means.

5. A carrying apparatus according to claim 4, wherein said means for fixing said continuation means to said slide means comprises:

a first toothing arrangement in one of said continuation means and said slide means;

insert means having a second toothing arrangement matingly engageable with said first toothing arrangement; and means for preventing movement of said insert means and the one of said continuation means and said slide means when said second toothing arrangement is matingly engaged with said first toothing arrangement, to establish the length of said coupling means.

6. A carrying apparatus according to claim 5, wherein said means for preventing movement of one of said continuation means and said slide means when said toothing arrangements are engaged, is comprised of:

an opening formed at the other of said continuation means and said slide means for receiving an insert means and preventing said movement.

7. A carrying apparatus according to claim 6, wherein said first toothing arrangement comprises a series of parallel teeth extending in a transverse direction relative to a ski for holding said apparatus, and the second toothing arrangement of said insert means has a shorter length in the transverse direction.

8. A carrying apparatus according to claim 6, wherein said insert means is not movable in the longitudinal direction of the ski when said second toothing arrangement is in mating engagement with said first said toothing arrangement.

9. A carrying apparatus according to claim 6, wherein said insert means is self-locking within said opening.

10. A carrying apparatus according to claim 6, wherein said carrying apparatus further comprises a cover means for covering said opening.

11. A carrying apparatus according to claim 10, wherein said cover means is dimensioned for engagement with said insert means to remove said insert means from said opening.

12. A carrying apparatus according to claim 10, wherein said cover means is dimensioned for engagement with said insert means to move said insert means, within said opening, into a position in which said second toothing arrangement means and said first toothing arrangement are matingly engageable with each other.

13. A carrying apparatus according to claim 10, wherein said cover means is a sliding cover having locking means for locking said cover in a closed position.

14. A carrying apparatus according to claim 1, wherein said carrying apparatus further comprises:

a hook means formed at the free end of said coupling means; and a hook-receiving means formed on the front support means, said hook means engageable with said hook-receiving means to transmit tensile forces between said front and rear support means when the ski is counter-flexed.

15. A carrying apparatus according to claim 14, wherein at least one of said hook means and said hook receiving means is resilient.

16. A carrying apparatus according to claim 15, wherein said length-adjustable coupling means is comprised of a continuation member detachably coupled to a slide means, said continuation member being longitudinally displaceable relative to the slide means to disengage said hook means from said hook-receiving means by pushing at least one of said hook means and said hook-receiving means away from a position allowing engagement.

17. A carrying apparatus according to claim 16, wherein a ramp means is arranged on at least one of said hook means and said hook-receiving means, said continuation member engageable with said ramp means to release said hook means from engagement with said hook-receiving means.

18. A ski binding having a slide member movable in a housing on a ski, said slide member being positionable in a specified location relative to said housing;

said slide member having a generally planar body portion and hook means extending from said body portion, said body portion and said hook means being slidable on said housing;

edge means defining a hook-receiving means in said housing, said hook-receiving means being in the path of said hook means as said slide member moves on said housing;

said hook means engaging said hook-receiving means when said slide member moves said hook means into operative engagement with said hook-receiving means, to releasably position said slide member relative to said housing; and a second member movable relative to said slide members, said second member being movable to disengage said hook means from said hook-receiving means to release said slide member from said housing.

19. A ski binding according to claim 18, wherein said hook means and said hook-receiving means transmit forces during skiing, and said hook means and said hook-receiving means damp the vibrations when a ski on which said ski binding is mounted, counterflexes.

* * * * *